US006558223B1

(12) United States Patent
Matthews

(10) Patent No.: US 6,558,223 B1
(45) Date of Patent: May 6, 2003

(54) TOY WATER DEVICE

(75) Inventor: Jeffrey Shane Matthews, Milner, GA (US)

(73) Assignee: Johnson Research & Development Company, Inc., Smyrna, GA (US)

( * ) Notice: Subject to any disclaimer, the term of this patent is extended or adjusted under 35 U.S.C. 154(b) by 0 days.

(21) Appl. No.: 10/101,023

(22) Filed: Mar. 18, 2002

Related U.S. Application Data

(63) Continuation-in-part of application No. 09/618,154, filed on Jul. 17, 2000, now abandoned.

(51) Int. Cl.[7] ..... A63H 23/00

(52) U.S. Cl. ..... 446/153; 446/159; 446/154; 239/225.1; 239/229; 239/247

(58) Field of Search ..... 446/159, 154, 446/153; 239/229, 225.1, 247, 17, 587.1, 587.2, 289, 246, 273, 275, 279, 280

(56) References Cited

U.S. PATENT DOCUMENTS

| | | | | | |
|---|---|---|---|---|---|
| 181,614 | A | | 8/1876 | Abbott | |
| 497,413 | A | | 5/1893 | Ruble | |
| 1,790,732 | A | | 2/1931 | Tichava | |
| 2,670,992 | A | | 3/1954 | Long | 299/67 |
| 2,954,932 | A | | 10/1960 | Albano | 239/188 |
| 3,170,171 | A | * | 2/1965 | Mayhew et al. | 472/128 |
| 3,363,268 | A | * | 1/1968 | Friedlander | 472/128 |
| 3,462,132 | A | | 8/1969 | Kaelin | 261/87 |
| 3,796,373 | A | | 3/1974 | Moore | 239/229 |
| 3,866,916 | A | * | 2/1975 | Clarke | 472/128 |
| 4,274,591 | A | | 6/1981 | Sunshine et al. | 239/188 |
| 4,573,679 | A | | 3/1986 | Janszen | 273/26 E |
| 4,655,722 | A | | 4/1987 | Baron et al. | 446/226 |
| 5,224,652 | A | | 7/1993 | Kessler | 239/211 |
| 5,297,979 | A | | 3/1994 | Amron | 446/16 |
| 5,462,284 | A | | 10/1995 | Felsenthal | 273/413 |
| 5,505,380 | A | | 4/1996 | Jun | 239/211 |
| 5,797,545 | A | | 8/1998 | Asinovsky | 239/279 |
| 6,050,501 | A | | 4/2000 | O'Rourke | 239/229 |

* cited by examiner

*Primary Examiner*—Derris H. Banks
*Assistant Examiner*—Urszula M Cegielnik
(74) *Attorney, Agent, or Firm*—Baker, Donelson Bearman & Caldwell

(57) ABSTRACT

A toy device is disclosed having a base (11), a main portion (12) and an elongated supply tubing (13) extending between the base (11) and the main portion (12). The main portion (12) includes a support in the form of an inflatable ball (17) and an equatorial, annular array of water jets (18) coupled tangentially to the ball (17). Each water jet (18) has a water line (19) extending therefrom to a central hub (20) in fluid communication with tubing (13).

16 Claims, 1 Drawing Sheet

Fig. 1
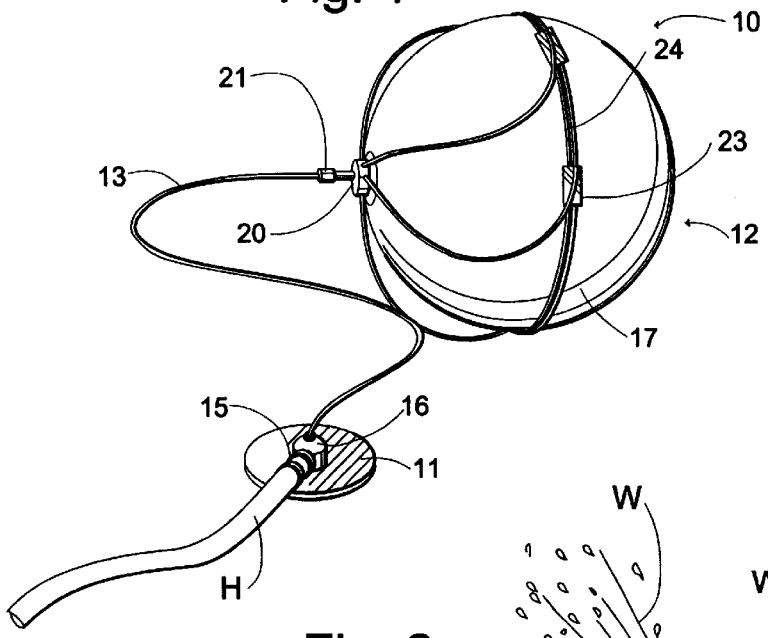
Fig. 2
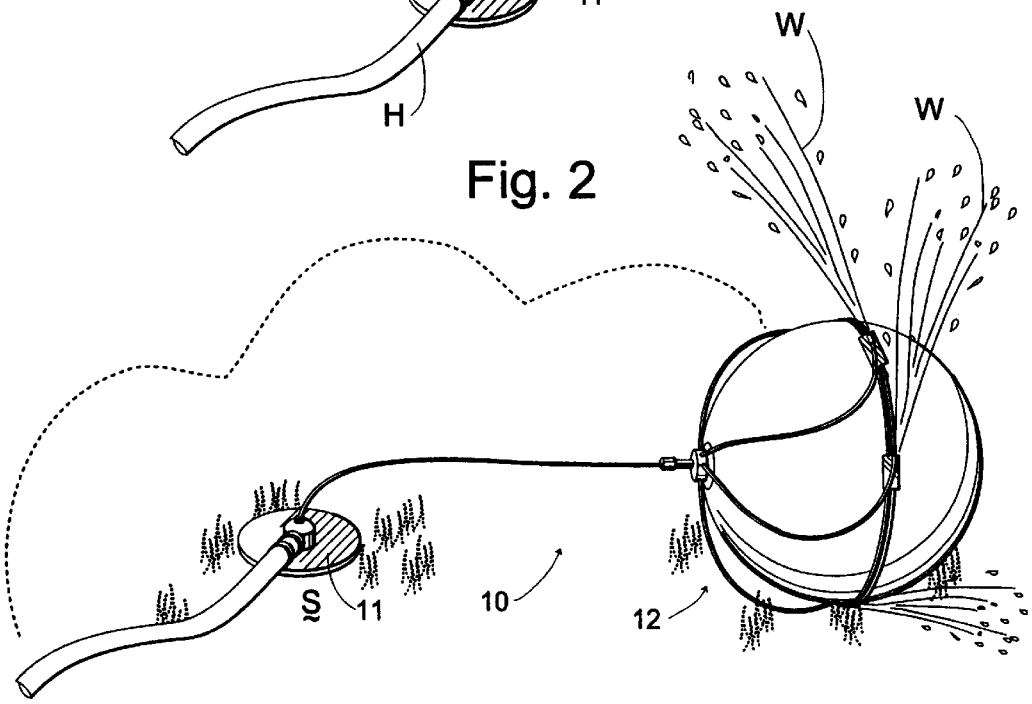
Fig. 3
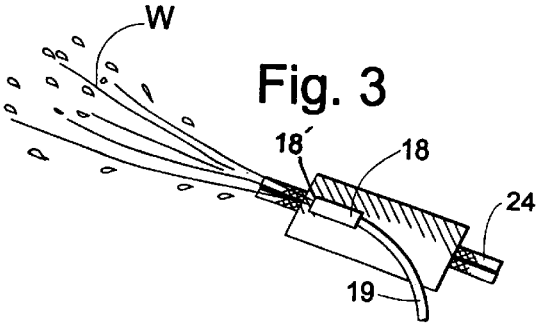
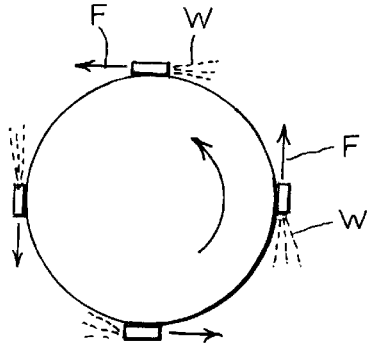
Fig. 4

TOY WATER DEVICE

REFERENCE TO RELATED APPLICATION

This is a continuation-in-part of U.S. patent application Ser. No. 09/618,154, filed Jul. 17, 2000, now abandoned, entitled TOY WATER DEVICE.

TECHNICAL FIELD

This invention relates to toy devices, and specifically to a toy devices which are moved through the expulsion of water.

BACKGROUND OF THE INVENTION

Toy devices which are driven by water jets have existed from many years. Many such devices are coupled to a conventional garden hose which is coupled to a municipal water system. The water pressure supplied by the municipal water system is transferred to the device wherein the water is expelled through a jet or nozzle to provide a driving force.

Most of these water driven toys have stationary bodies with movable arms, legs, wheels or other members. The pressurized water force is utilized in these devices to pivot, rotate or otherwise move the movable member or portion of the toy. These devices however are relatively stationary in nature.

A few toy devices have been devised which utilize the water pressure to propel the entire toy. These toys typically includes water jets which provide a propulsion force-sufficient to move the toy device through the air or across an underlying support surface. Some of these water propelled toys have included elongated tubing which provides a constant supply of pressurized water to a main portion of the device which included the water jet nozzle.

As a constant water jet stream is created by the nozzle the toy is suppose to move in a constant but random or erratic manner. The erratic movement of the device enables games with children wherein the goal is either to catch the moving main portion or conversely to avoid being hit by the main portion. Additionally, the water jet emitted from the toy may be included into playability of the game. However, as these toys contact the ground they oftentimes become oriented downward and as a result the toy becomes "stuck" as it tries to move downward against the ground. This positioning of the toy device typically brings a disruption or even halt to the game.

Accordingly, it is seen that a need remains for a water driven device which is extremely mobile but which does not become stuck in certain positions. It is to the provision of such therefore that the present invention is primarily directed.

SUMMARY OF THE INVENTION

In a preferred form of the invention a toy water device comprises a main portion having a generally spherical support and an plurality of liquid jets mounted to the support. The toy water device an elongated tubing in fluid communication with the plurality of liquid jets and coupleable to a pressurized liquid supply. With this construction, the expulsion of water from the jets creates a moving force upon the spherical support.

BRIEF DESCRIPTION OF THE DRAWING

FIG. 1 is a perspective view of a toy water device embodying principles of the invention is a preferred form, shown coupled to a conventional garden hose.

FIG. 2 is a perspective view of the toy water device of FIG. 1, shown in motion.

FIG. 3 is a top view of a portion of the toy water device of FIG. 1.

FIG. 4 is a schematic top view of the toy water device of FIG. 1.

DETAILED DESCRIPTION

With reference next to the drawings, there is shown a toy device 10 incorporating principles of the invention in a preferred form. The toy device 10 has a base 11, a main portion 12 and an elongated supply tubing 13 extending between the base 11 and the main portion 12. The base 11 has a conventional garden hose receiver 15 and a fully rotatable joint 16 from which extends tubing 13. The term conventional garden hose receiver 15 is meant to describe any internally threaded or female coupler sized and shaped to mate with an externally threaded or male end of a common garden hose.

The main portion 12 includes a support in the form of an inflatable ball 17 and an equatorial, annular array of water jets 18 coupled tangentially to the ball 17. Each water jet 18 has an exit opening 18' through which the water is expelled which is oriented generally tangential to the ball. The inflatable ball 17 is very light in weight and therefore virtually any force applied to the ball results in ball movement in that direction. A glancing force or tangential force applied to the exterior surface of the ball will force the ball to rotate or spin in the direction of the force. Each water jet 18 has a water line 19 extending therefrom to a central hub 20 in fluid communication with tubing 13. The central hub 20 also includes a fully rotatable joint 21 coupled to the elongated tubing 13. The water jets 19 may be mounted to the ball 17 through the use of adhesives, loop and hook fasteners 23, an elastic band 24 or a combination of such, as best shown in FIG. 3.

In use, with the base 11 positioned upon a generally flat surface S, such as a lawn. A conventional garden hose H is coupled to a common household outdoor water faucet that is coupled in fluid communication through water pipes to a municipal water system which supplies water under pressure. The garden hose is coupled to the base 11 by threading the male end of the garden hose into the female base receiver 15.

With pressurization of the water hose H water passes through the base 11 and tubing 13 to the central hub 20. The water stream is then separated within the hub so as to pass simultaneously through the multiple water lines 19 to each water jet 18. The water in then expelled or emanated from the water jets 18 as multiple water streams W that are oriented generally tangential, to the ball 17. The term tangential is not intended to be limited to an exactly tangential line from the exterior surface of the ball but a line generally tangential to or glancing off the exterior surface so that it imparts a spinning force upon the ball, i.e. a line which is not directed to the center point of the ball. The thrusting forces of the water streams are imparted upon the ball as forces F in a direction generally tangential to the ball 17 and opposite to the direction of the water streams W, as best shown in FIG. 4. The tangential forces produced by the jets 18 cause the ball 17 to rotate or spin about the axes of the ball as the force is directed at an angle from the center point of the ball and as such is an angular force inducing a spinning motion. The physics of anular forces upon a body are described in COLLEGE PHYSICS by Serway & Faughn, Second Edition Chapter 7.4 Relations between Angular and Linear Quantities, which is specifically incorporated herein by reference. It should be understood that the ball is of such light weight that virtually any force imparted upon the ball moves the ball in that direction. As such, a tangential force upon the ball causes the ball to rotate about its center point, as is commonly understood by the use of conventional lawn sprinklers and the like as shown in U.S. Pat. Nos. 497,413 and 2,954,932.

As the ball 17 rotates or spins it naturally contacts the underlying surface S, thereby causing the ball 17 to jump, bounce or spin upon its axes in a random fashion. The rotatable joints 16 and 21 prevent the tubing 13 from twisting as the ball rotates so as to allow unencumbered or unrestrained movement of the ball as it revolves about the base.

It should be understood that other shaped balls may be used as an alternative to the sphere shown in the preferred embodiment, as other similar shaped may be utilized so long as the shape allows rotary motion over an underlying surface. As such, the terms "sphere" and "ball" should not be understood to mean only perfectly round bodies. Lastly, it should be understood that as an alternative the device may be designed without the base and with the elongated tubing coupled directly to the garden hose.

While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A toy water device comprising:

a main portion having a generally spherical support and an plurality of liquid jets mounted to said support, said liquid jets being mounted relative to said spherical support so that liquid streams emanating from said liquid jets are oriented generally tangential to said spherical support so as to impart a force which is generally tangential to said spherical support;

an elongated, flexible tubing in fluid communication with said plurality of liquid jets and coupleable to a pressurized liquid supply, whereby the expulsion of water from the jets creates a tangential moving force upon the spherical support.

2. The toy water device of claim 1 wherein said plurality of liquid jets are mounted to said spherical support in an annular array.

3. The toy water device of claim 1 further comprising a base in fluid communication with said elongated tubing opposite said main portion.

4. The toy water device of claim 3 wherein said base includes a rotatable joint, whereby the rotatable joint allows for rotary movement of said elongated tubing relative to said base.

5. The toy water device of claim 1 wherein said plurality of liquid jets are coupled in fluid communication to a central hub coupled to said spherical support.

6. The toy water device of claim 5 wherein said central hub includes a rotatable joint, whereby the rotatable joint allows for rotary movement of said elongated tubing relative to said spherical support.

7. The toy water device of claim 6 further comprising a base in fluid communication with said elongated tubing opposite said support.

8. The toy water device of claim 7 wherein said base includes a rotatable joint, whereby the rotatable joint allows for rotary movement of said elongated tubing.

9. A toy water device comprising:

a main portion having a support and an plurality of liquid jets having liquid exit openings oriented to generate liquid streams oriented generally tangentially to said support;

an elongated, flexible tubing in fluid communication with said plurality of liquid jets and coupleable to a pressurized liquid supply, whereby the expulsion of water from the jets creates a tangential moving force upon spherical support.

10. The toy water device of claim 9 wherein said plurality of liquid jets are mounted to said support in an annular array.

11. The toy water device of claim 9 further comprising a base in fluid communication with said elongated tubing opposite said main portion.

12. The toy water device of claim 11 wherein said base includes a rotatable joint, whereby the rotatable joint allows for rotary movement of said elongated tubing relative to said base.

13. The toy water device of claim 11 wherein said plurality of liquid jets are coupled in fluid communication to a central hub coupled to said main portion.

14. The toy water device of claim 13 wherein said central hub includes a rotatable joint, whereby the rotatable joint allows for rotary movement of said elongated tubing relative to said support.

15. The toy water device of claim 14 further comprising a base in fluid communication with said elongated tubing opposite said support.

16. The toy water device of claim 15 wherein said base includes a rotatable joint, whereby the rotatable joint allows for rotary movement of said elongated tubing.

* * * * *